US005496575A

United States Patent [19]

Newarski

[11] Patent Number: 5,496,575

[45] Date of Patent: Mar. 5, 1996

[54] SINGLE USE CEREAL AND MILK CONTAINER

[76] Inventor: Emil Newarski, 135 Jay Ave., Lyndhurst, N.J. 07070

[21] Appl. No.: 341,747

[22] Filed: Nov. 18, 1994

[51] Int. Cl.[6] ..... B65D 23/04

[52] U.S. Cl. ..... 426/115; 206/222; 206/541; 220/501; 426/120; 426/130

[58] Field of Search ..... 426/112, 115, 426/120; 220/501; 206/222, 541, 549

[56] References Cited

U.S. PATENT DOCUMENTS

| | | | |
|---|---|---|---|
| 400,752 | 4/1889 | Crossman | 206/541 |
| 620,891 | 3/1899 | Curtis | 206/541 X |
| 2,011,996 | 8/1935 | Belk | 206/549 |
| 2,207,417 | 7/1940 | Smith | 220/501 X |
| 2,597,567 | 5/1952 | Como | 206/541 X |
| 2,885,104 | 5/1959 | Greenspan | 206/222 |
| 3,442,435 | 5/1969 | Ludder et al. | 426/120 X |
| 5,167,973 | 12/1992 | Snyder | 426/115 |
| 5,209,348 | 5/1993 | Schafer, III | 206/222 |
| 5,241,835 | 9/1993 | Ascone | 220/501 X |

FOREIGN PATENT DOCUMENTS

| | | | |
|---|---|---|---|
| 2218962 | 11/1989 | United Kingdom | 426/120 |

*Primary Examiner*—Bryon P. Gehman
*Attorney, Agent, or Firm*—O'Connor Cavanagh

[57] ABSTRACT

A single use cereal and milk container is formed of a first container of paperboard laminate construction containing a supply of milk in an aseptically sealed condition, and a second container of plastic coated paperboard construction for holding a supply of cereal in a sealed stay fresh condition, and a user operable valve on the first container and disposed to an orifice in the second container for selectively breaking the aseptic seal to allow the supply of milk to gravity flow from the first container through the orifice into the second container and onto the cereal. A paperboard box holds the first and second container in juxtaposition and as an integral unit. The user first opens the second container by breaking the stay fresh seal to access the cereal and the valve. A spoon is disposed within the second container for ready use after accessing the cereal and before opening the valve. In one embodiment, an end portion of the spoon is specially formed to break the aseptic seal and open the valve. The container is shelf storable, product displayable and readily disposable after single use.

11 Claims, 3 Drawing Sheets

FIG. 5
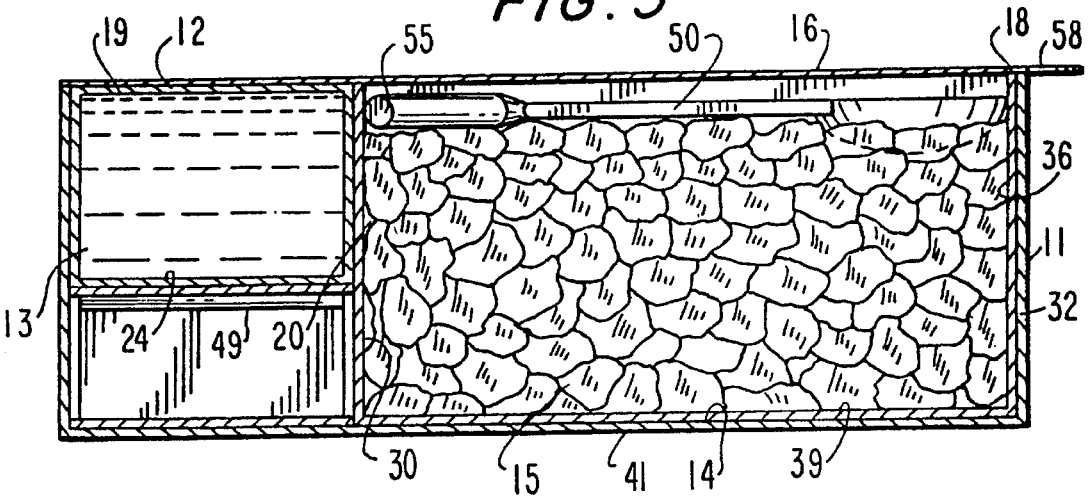
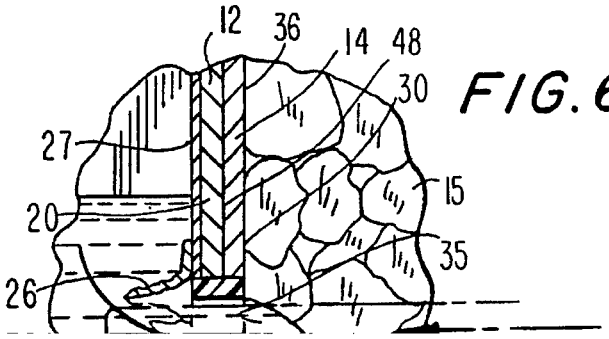
FIG. 6

SINGLE USE CEREAL AND MILK CONTAINER

BACKGROUND OF THE INVENTION

1. Field of the Invention

This invention relates to a new and improved single use container. In one respect this invention relates to a single use paperboard and thermoplastic construction container wherein a liquid is aseptically stored and material combinable with the liquid separately stored, and the liquid selectively combined with the material. More particularly, this invention relates to a single use container for the aseptic storage of milk and for the fresh pack storage of cereal, with selectively opening of the container and breaking the aseptic seal to allow the milk to flow onto the cereal.

2. Description of the Related Art

In the field related to aseptic drink containers, it is known to provide a packet of paperboard or plastic film laminate construction for aseptic packaging, with an aperture formed in the top of the packet exposing a thinner area of foil or plastic which the user punctures with the end of a straw. Such constructions are disclosed and discussed in U.S. Pat. No. 4,287,247, issued Sep. 1, 1981 to Reil et al, U.S. Pat. No. 5,303,838, issued Apr. 19, 1994 to Luch et al, and U.S. Pat. No. 4,789,066, issued Dec. 6, 1988 to Lisiecki.

In the field related to cereal and milk bowls, it was known to provide a cereal bowl with separate self-contained cereal and milk compartments, as disclosed in U.S. Pat. No. 5,209,348, issued May 11, 1993 to Schafer. The construction disclosed in Schafer is designed to be reusable, and necessarily must be refrigerated in storage prior to use, and then re-washed after use. Schafer provides a valve of complex mechanical design. The Schafer valve extends outwardly from the bowl and can be inadvertently actuated to discharge the milk onto the cereal prior to the desired use.

The art lacked a single use, commercially practical, disposable, readily and reliably useable cereal and milk container.

SUMMARY OF THE INVENTION

A single use container for cereal and milk is formed of a first container for aseptically storing a measured supply of milk and a second container for the stay-fresh sealed storage of a measured amount of cereal, with the second container juxtaposed to the first container, and a valve operatively positioned to the first and second containers, so that the user first selectively opens the second container to access the cereal and the valve and then actuates the valve by breaking the aseptic seal to allow the milk to gravity flow from the first container onto the cereal in the second container. The valve is protectively disposed in the first container and accessible only from the second container and not accessible until the seal of the second container is broken, thereby avoiding inadvertent breaking of the aseptic seal and concommitant discharge of the milk.

In one embodiment, the valve is a formed of a frangible plastic or metal foil element forming part of the aseptic seal of the first container, and the second container is formed with an orifice disposed adjacent to the valve so that the milk flows from the first container through the broken frangible element and the orifice into the second container.

In another embodiment, a plastic spoon is designed to be and is positionally disposed within the second container. An end portion of the spoon is specially contoured to permit the user to readily break the frangible seal element.

The first and second containers are preferrably of rectilinear configuration, with a rectilinear cover or box to hold the first and second containers so as to provide an integral, shelf storeable, stackable and displayable single use construction.

In a most preferred embodiment, the first and second containers are of essentially paperboard and thermoplastic laminate construction, and the cover or box of similar construction.

The container of the present invention is single use and yet ecologically disposable.

BRIEF DESCRIPTION OF THE DRAWINGS

The accompanying drawings, which are incorporated in and form a part of this specification, illustrate embodiments of the invention and, together with the description, serve to explain the principles of the invention:

FIG. 5 is a sectional view taken along line 5—5 of FIG.2 and

FIG. 6 is a fragmentary view as in FIG. 4 but showing the container in operation.

DETAILED DESCRIPTION OF THE PREFERRED EMBODIMENTS

Figure 1:
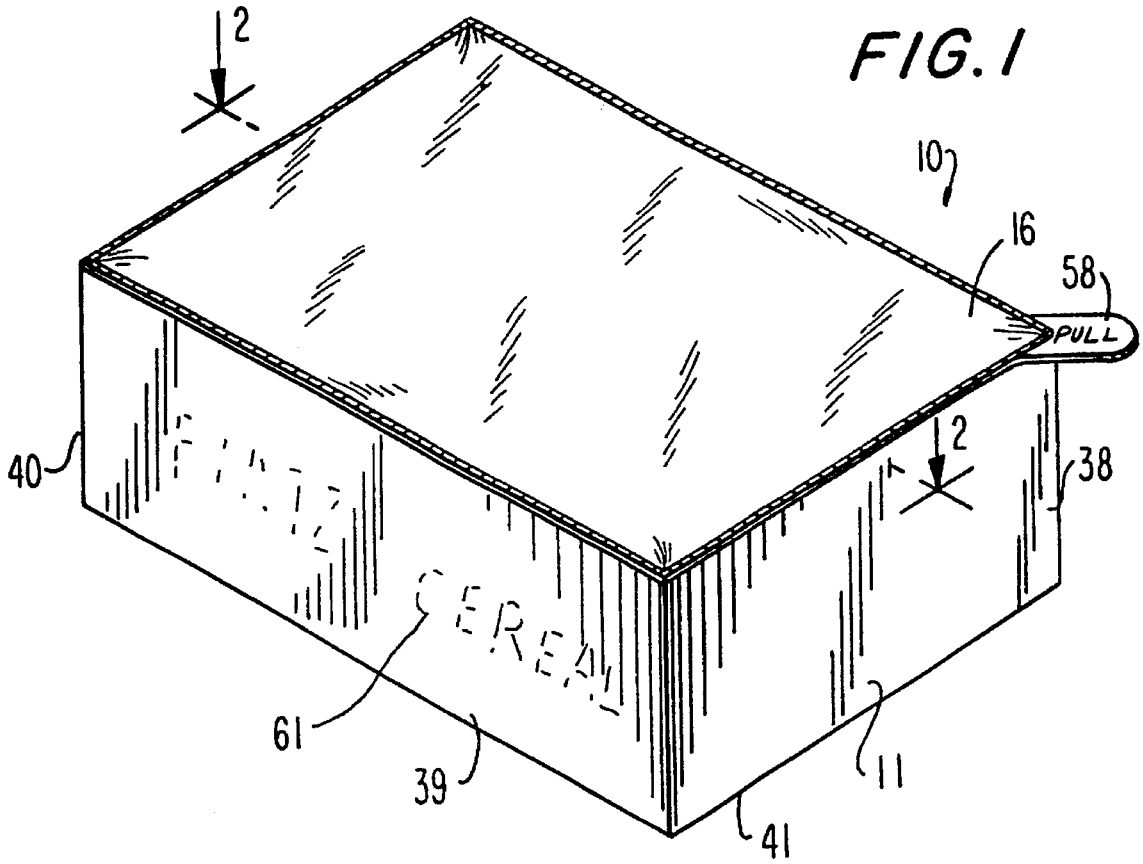
FIG. 1 is a perspective view of the container of the present invention.
Figure 4:
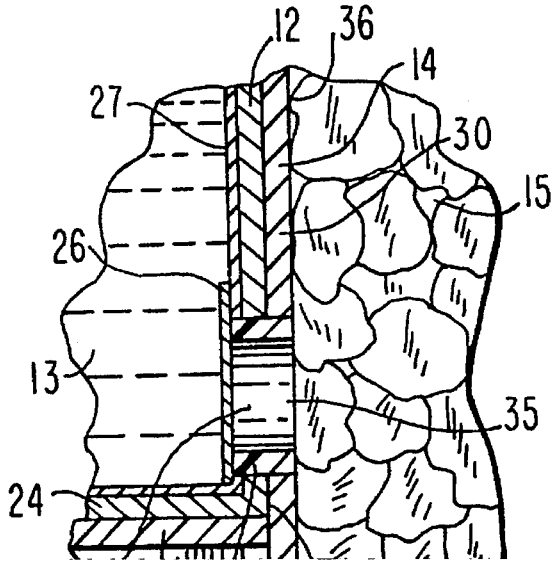
FIG.4 is an enlarged fragmentary sectional view taken along line 4—4 of FIG. 2.
Figure 2:
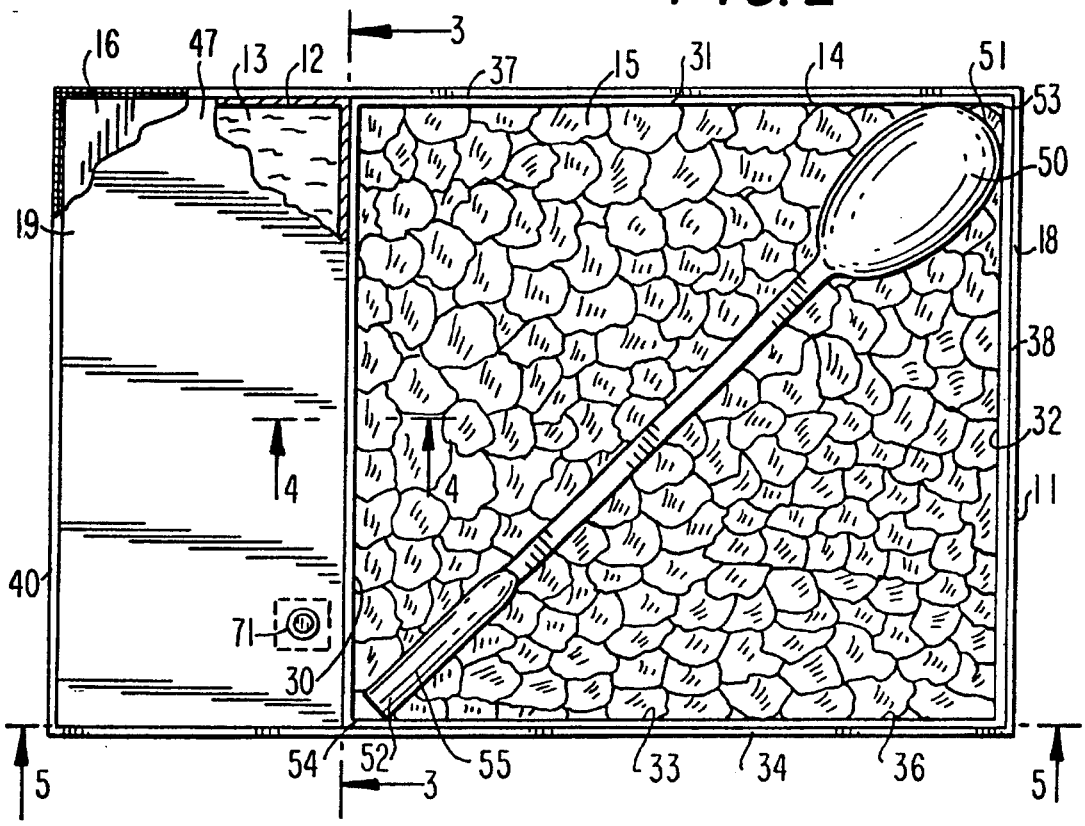
FIG. 2 is an enlarged sectional and partial fragmentary view taken along line 2—2 of FIG. 1.
Figure 3:
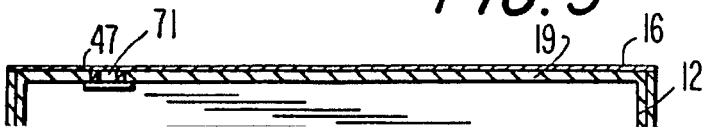
FIG. 3 is a sectional view taken along line 3—3 of FIG. 2.

Reference is made in detail to the preferred embodiments of the invention, examples of which are illustrated in the accompanying drawings.

Referring to the FIGS. there is showing the container 10 of the present invention. Container 10 is formed of a paperboard box or cover 11 holding a first paperboard container 12 for aseptically storing a measured amount of milk 13, a second paperboard container 14 for holding a measured supply of cereal 15, and a metal or thermoplastic foil top 16 adhesively sealed to the top edges 18 of box 11 to vacuum seal the cereal in container 14. A paperboard rectilinear sleeve or spacer 17 is provided on which container 12 is supportably mounted and in operative disposition to container 14. Box 11 maintains container 12, container 14 and sleeve 17 in frictional contact. Container 12 may alternatively be thermoplastically sealed or adhesively bonded to container 14 to maintain contact, for reasons hereinafter appearing.

Container 12 is formed of generally rectilinear construction and has a top 19, sides 20, 21, 22 and 23, and bottom 24. Side 20 is formed with a recessed orifice 25, disposed adjacent bottom 24. A valve is formed of frangible metal or thermoplastic foil piece 26 which overlaps orifice 25 and is integrally bonded to inside laminate layer 27 of container 12 to maintain the aseptic seal, and a tubular plastic member 70. Member 70 is bonded to foil piece 26, and the walls or sides 20 and 30 to provide an integral construction. The valve for the aseptic package construction may be constructed as shown and described in U.S. Pat. No. 5,303,838. Bottom 24 is provided with a slight central fold on trough 49, for purposes hereinafter appearing. Container 12, is of paperboard and thermoplastic or foil laminate construction for the aseptic storage of milk, such is shown and described in U.S. Pat. No. 4,287,247 and U.S. Pat. No. 4,789,066.

Container 14 is formed of a paperboard rectilinear construction having sides 30, 51, 32, 33, and bottom 34. Side 30 and member 70 form through hole or orifice 35 which is coincidentally disposed to orifice 25 of container 12 for purposes hereafter appearing. As previously mentioned, an adhesive or thermoplastic bond 48 may be employed to seal or bond side 20 of container 12 to side 30 of container 14. This seal or bond surrounds member 70 and maintains the integral construction. The paperboard of container 14 may be thermoplastically lined or coated 36 on the inside of container 14. A measured amount of dry breakfast cereal, such as flakes 15, is contained at the bottom of container 14. Liner 36 protects the stay fresh condition of the cereal, and the liner 36 helps contain the milk and cereal within container 14.

A second valve 71, similar in construction to valve 70, is disposed in the top 19 of container 12. Valve 71 may, after removal of foil 16, be punctured with the end of straw in the well known manner. Valve 71 may be opened prior to opening valve 70 so that the user may drink some of the milk prior to adding the remainder to the cereal. Valve 71 also serves as an air relief to provide the even flow of milk from valve 70. It is to be born in mind that the invention is operable without valve 71, and the inclusion of valve 71 is an alternate embodiment.

Box 11 is of paperboard construction and is of rectilinear configuration having sides 37, 38, 59, 40 and bottom 41. The cardboard folded sleeve 17 is positioned in box 11. Container 12 is supportably mounted on sleeve 17. Containers 12 and 14 and sleeve 17 are frictionally held and secured within box 11. The foil top piece 16 is releasably adhesively bonded to contiguous top edge 18 of the sides of container 14, the top edge of the sides of box 11, and to face or surface 47 of top 19 of container 12, to vacuum seal the cereal in container 14, by means well known in the packaging art. Foil piece 16 is provided with lift or pull tab 58. The rectilinear folded paperboard construction of units 12, 14, 17 and 11 are well known, and such rectilinear boxes or containers are readily constructed by those skilled in the box making art.

A molded thermoplastic spoon 50 is sized and contoured to be removably positioned at its ends 51 and 52 in respective corners 53 and 54 of container 14. Spoon 50 is formed with a cylindrical end portion 55 which is sized to be slidable within holes 25 and 35, for reasons hereinafter.

By means of the aforesaid construction, cereal 15 is vacuum sealed in container 14, with spoon 50 disposed on the cereal and at the corners of container 14. A measured supply of whole or UHT-processed milk 13 is aseptically packaged in container 12.

In operation, the user lifts pull tab 58 of foil piece 16 to break the vacuum seal and pulls or removes the foil piece 16. In this manner, the user accesses spoon 50 and cereal 15, and valve foil piece 26. The user then moves spoon 50 through the cereal and inserts end portion 55 through member 70 and holes 35 and 25 to break foil piece 26. With removal of the spoon end 55, the milk 13 gravity flows from container 12 through member 70 and orifices 35 and 25 into container 14 and onto cereal 15. Fold 49 at the bottom 24 of container 12 ensures that essentially all the milk gravity flows out of container 12.

It is important to note that foil piece 26 is recessed in holes 35 and 25 so that it cannot be inadvertently damaged or broken, and may only be broken once the user opens container 14 and then purposefully inserts the specially designed end 55 of spoon 50.

The box 11, containers 12 and 14, and sleeve 17 constructions provide an integral unit which may be stacked and stored on supermarket shelves. Box side 39, by way of example, provides product display information 61.

The box 11, containers 12 and 14 and sleeve 17 may be of paperboard or fiberboard construction or like conventional construction, and may be coated and/or impregnated with thermoplastics or waxes, so as to provide semi-rigid, protective packaging.

After the user consumes the cereal and milk, the container may be readily ecologically disposed in receptacles designated for waste plastic and paperboard.

It is within the broad contemplation of this invention to provide for all known, and to be invented, forms of milk, such as by way of example, whole, skimmed, low-fat, and the like, and all forms of cereal, such as by way of example, flakes, puffs, granules, and the like. It is also within the broad contemplation of the invention that any liquid and liquid combinable material may be stored and used in the semi-rigid container construction.

The frangible foil construction may be as shown and described in U.S. Pat. No. 5,303,838 and U.S. Pat. No. 4,789,066, as is well known in the art. The valve may be a specially designed aseptic orifice seal which is first molded and constructed and then thermoplastically bonded to the aseptic container, as is shown and described in U.S. Pat. No. 5,303,838.

The foregoing description of specific embodiments of the present invention has been presented for purposes of illustration and description. They are not intended to be exhaustive or to limit the invention to the precise forms disclosed, and many modifications and variations are possible in light of the teaching and within the contemplation of the present invention. The embodiments were chosen and described in order to best explain the principles of the invention and its practical application to those skilled in the art. It is intended that the scope of the invention be defined by the claims appended hereto and their equivalents.

What is claimed is:

1. A single use cereal and milk container comprising; first container means for hermetically housing a single serving of cereal, a single serving of cereal disposed in said first container means, and second container means for aseptically housing a supply of milk for said cereal, a supply of milk disposed in said second container means, and wall means separating said first container means and said second container means, said first container means and said second container means having respective bottom walls adjacent to said wall means, said second container bottom wall being disposed above said first container bottom wall, and means for integrally forming said wall means with said first container means and said second container means so as to provide an integral container comprised of said first container means, said second container means and said wall means, said wall means having a first side and a second side oppositely disposed from said first side, said first side comprising said first container means for hermetically housing said cereal and said second side comprising said second container means for aseptically housing said milk, said cereal contactingly engaging said first side and said milk contactingly engaging said second side, said wall means being formed with orifice means communicating with the first and second container means, destructible means for aseptically sealing the milk, said aseptic sealing means being disposed on the wall means and covering said orifice means, said orifice means and aseptic sealing means being disposed adjacent said second container means bottom wall so that with destructing the aseptic sealing means the milk gravity flows from the second container means to the first container means, said first container means comprising cover means for covering the cereal and further comprising said means for hermetically sealing said cereal within the first container means, whereby a user removes said cover means and accesses the cereal and the aseptic sealing means and then destructs the aseptic sealing means to cause the milk to flow from the second container means through the orifice means and wall means into the first container means onto the cereal, and whereinafter the container is not again useable.

2. The container of claim 1, each said first and second container means comprising paperboard construction.

3. The container of claim 1, said destructible aseptic sealing means comprising frangible metal element.

4. The container of claim 3, further comprising a spoon, said spoon having a contoured end portion for destructibly breaking the frangible metal element.

5. The container of claim 1, further comprising box means for holding the first and second container means.

6. The container of claim 5, said box means comprising rectilinear construction, and said first container means and said second container means each comprising a generally rectilinear construction, said box means contactingly engaging said first container means and said second container means.

7. The container of claim 1, said first container means, said second container means and said wall means comprise semi-rigid self-supporting construction.

8. The container of claim 7, said construction comprising fiberboard.

9. The container of claim 1, further comprising annular thermoplastic means disposed in said wall means and being formed with said orifice means and extending from the first side to the second side.

10. The container of claim 1, said second container means being formed with second orifice means, said second orifice means being disposed above said first orifice means, and second destructible aseptic sealing, and said second aseptic sealing means being disposed and covering said second orifice means, whereby with destructing said first and second aseptic sealing means, the milk freely flows onto the cereal.

11. The container of claim 10, said cover means further comprising means for covering said second orifice means before removal of the cover means.

* * * * *